US005408714A

United States Patent [19]

Lemke

[11] Patent Number: 5,408,714

[45] Date of Patent: Apr. 25, 1995

[54] SEAT CUSHION

[76] Inventor: Stuart H. Lemke, 349 River Bluff Dr., Mosinee, Wis. 54455

[21] Appl. No.: 111,618

[22] Filed: Aug. 25, 1993

[51] Int. Cl.[6] ..... A47C 16/00

[52] U.S. Cl. ..... 5/653; 5/656; 5/476; 297/4; 297/452.21

[58] Field of Search ..... 297/4, 452.21; 5/652–654, 656, 448, 476

[56] References Cited

U.S. PATENT DOCUMENTS

| | | | |
|---|---|---|---|
| 2,277,853 | 3/1942 | Kohn | 5/476 |
| 3,974,532 | 3/1976 | Eichuya | 5/448 X |
| 4,713,854 | 12/1987 | Graehe | 5/448 X |
| 4,753,478 | 6/1988 | Weinreich | 297/4 X |
| 4,923,247 | 5/1990 | Malmstrom | 297/4 |
| 5,044,027 | 9/1991 | Moon | 5/449 |

FOREIGN PATENT DOCUMENTS

| | | | |
|---|---|---|---|
| 2055173 | 2/1981 | United Kingdom | 5/476 |

*Primary Examiner*—Michael F. Trettel
*Attorney, Agent, or Firm*—Andrus, Sceales, Starke & Sawall

[57] ABSTRACT

An outdoor seat cushion includes a first enlarged curved cushion piece connected to a second enlarged cushion piece in such a manner that a portion of reduced thickness is formed between the first and second pieces.

11 Claims, 2 Drawing Sheets

SEAT CUSHION

BACKGROUND OF THE INVENTION

The present invention relates to a seat cushion and more particularly to a seat cushion that is specifically adapted to be used outdoors.

In the past, hunters, birdwatchers or other outdoorsmen who, during the course of their activities, would assume a seated position, were required to carry a pillow-type cushion or a slab of cushioning material to cushion their body when seated on the ground, a rock or fallen tree. The pillow-type cushion did not conform to the log or the user's body and it was very bulky, uncomfortable to use and could easily leak its filling. The slab-type of cushion did not give proper cushioning and did not conform to the user's body. Also, it would not provide sufficient warmth, since very little of the insulating material actually touched the user's body.

It is an object of the present invention to provide an outdoor seat cushion that will conform to either the user's body or the object on which the user is sitting.

It is also an object of the invention to provide a seat cushion that is easily transported by the user.

SUMMARY OF THE INVENTION

An outdoor seat cushion includes a first enlarged curved cushion piece that is connected to a second enlarged curved cushion piece in such a manner that a portion of reduced thickness is formed between the first and second pieces.

In accordance with another aspect of the invention, the curved cushion pieces are formed of a resilient material and connected to a planar base portion in such a manner that a hollow area is formed between the planar portion and the curved portions.

In accordance with still another aspect of the invention, fastening means in the form of an elongated strap extends through one of the hollow areas and around the body of the user.

The present invention thus provides a light seat cushion that may be worn by the user and which is contoured to fit the body of the user and/or the object on which the user is sitting.

BRIEF DESCRIPTION OF THE DRAWINGS

The drawings illustrate the best mode presently contemplated of carrying out the present invention.

In the drawings.

DETAILED DESCRIPTION OF THE PREFERRED EMBODIMENT

Figure 1:
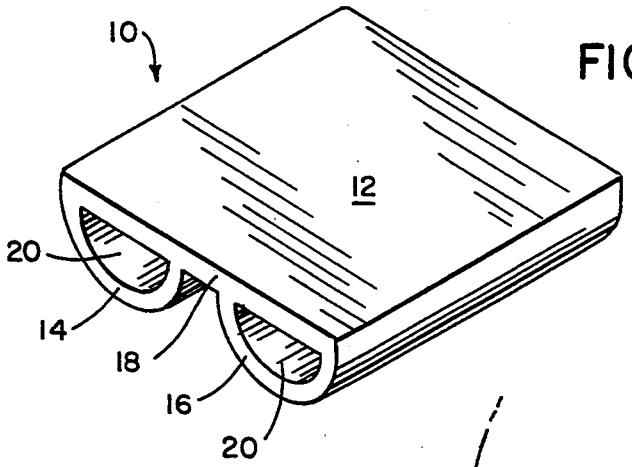
FIG. 1 is a perspective view of a seat cushion constructed according to the present invention.

As shown in FIG. 1, a seat cushion 10 includes a planar portion 12 from which extends a first curved piece 14 and a second curved piece 16. Planar portion 12 and curved pieces 14 and 16 are integrally formed from a resilient cushioning material. Since it is intended that seat cushion 10 be used outdoors, the resilient material should preferably be water resilient to some degree.

Curved pieces 14 and 16 are disposed on planar portion 12 in such a manner that an intermediate portion 18 of reduced thickness is formed between curved pieces 14 and 16.

Also, curved pieces 14 and 16 are of a thickness so as to provide a pair of hollow areas 20 between planar portion 12 and curved pieces 14 and 16.

Figure 2:
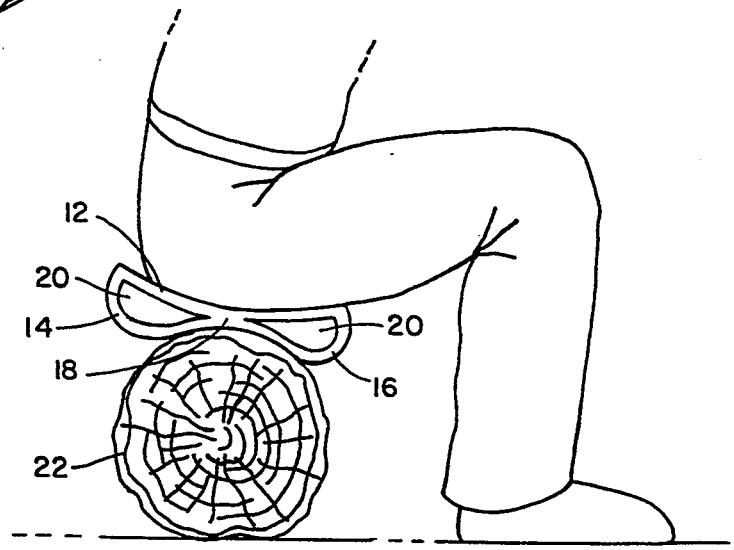
FIG. 2 is a side view of the seat cushion of FIG. 1 shown in use.

As shown in FIG. 2, this contour design of seat cushion 10 particularly lends itself to use with a log 22. When used in this manner, curved portions 14 and 16 conform to the arcuate surface of log 22 and yet urge planar portion 12 into contact with the upper legs and posterior of the user, thus providing a greater degree of comfort and warmth than an ordinary slab of resilient material which would merely drape itself along the circumference of log 22.

Figure 3:
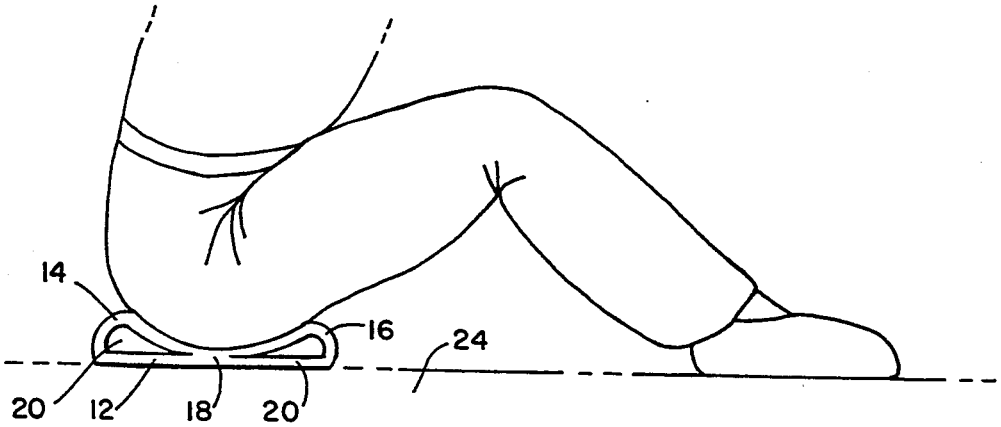
FIG. 3 is a side view of the seat cushion of FIG.1 shown in another form, of use.

As shown in FIG. 3, seat cushion 10 can be used on an area of flat ground 24. When used in this manner, seat cushion 10 is reversed so that planar portion 12 is in contact with the ground and curved pieces 14 and 16 are in contact with the body of the user. Once again, the specific contour provided by reduced thickness portion 18 aids in positioning the surface of seat cushion 10 along the body of the user.

Figure 4:
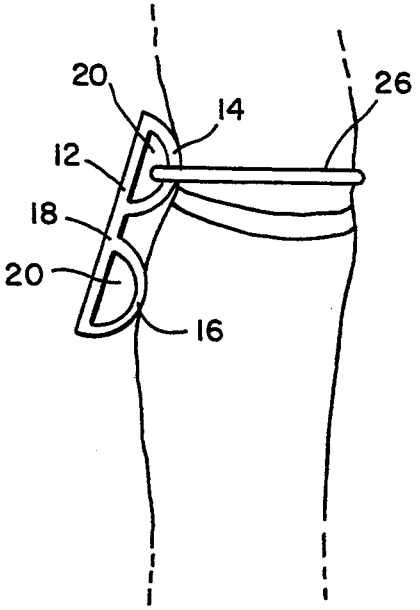
FIG. 4 is a side view of the seat cushion of FIG. 1 with a carrying attachment.
Figure 5:
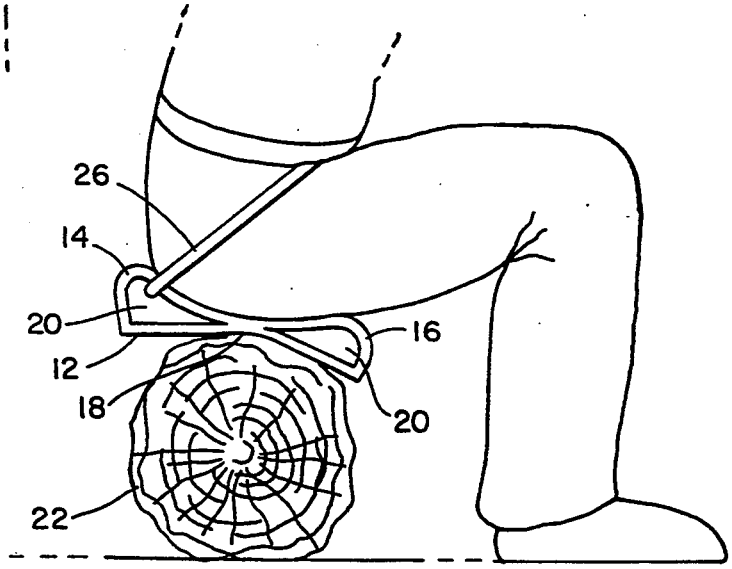
FIG. 5 is a side view of the seat cushion of FIG. 5 shown in use.

FIG. 4 illustrates the use of a fastening means in the form of an elastic elongated strap 26 that passes through one of the hollow areas 20 and around the body of the user. This allows seat cushion 10 to be transported by the user without the use of the user's hands. When it is desired to use seat cushion 10, the user merely slides seat cushion 10 into position as shown in FIG. 5 so that it is not necessary to remove strap 26 in order to use cushion 10.

Figure 6:
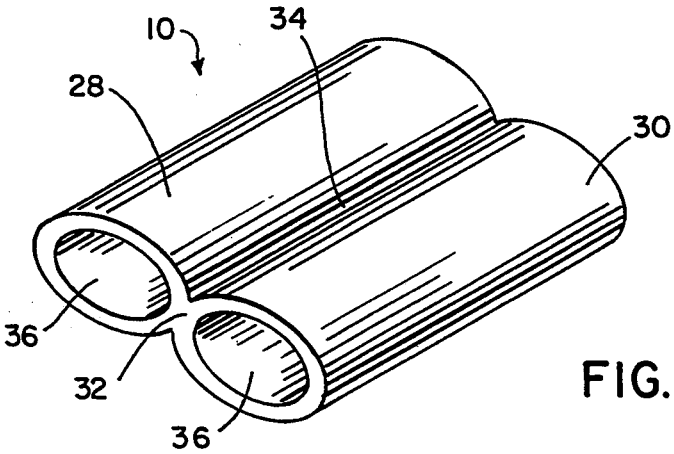
FIG. 6 is a perspective view of an alternate embodiment of the seat cushion.

FIG. 6 illustrates an alternate embodiment of the invention in which seat cushion 10 is provided with a first hollow tubular member 28 of resilient material connected to a second hollow tubular member 30 of resilient material. Tubular members 28 and 30 are connected at a point 32 along the circumference of each member so that a portion of reduced thickness 34 is formed between tubular members 28 and 30. The hollow areas 36 of tubular members 28 and 30 -allow for the use of fastening strap 26.

Various modes of carrying out the invention are contemplated as being within the scope of the following claims particularly pointing out and distinctly claiming the subject matter regarded as the invention.

I claim:

1. A seat cushion having a lateral dimension comprising:

a first enlarged and elongated curved cushion piece extending along substantially the entire width of the seat cushion, a second enlarged and elongated cushion piece connected to said first piece so that a cushion portion of reduced thickness is formed between said first and second pieces with both said reduced thickness portion and said second cushion piece extending along substantially the entire width of the seat cushion and at least one of said first and second cushion pieces comprises a planar portion and an arcuate portion connected to said planar portion.

2. The seat cushion defined in claim 1 wherein at least one of said first and second cushion pieces comprises a planar portion and an arcuate portion connected to said planar portion so that a hollow area is formed between said planar portion and said arcuate portion.

3. The seat cushion defined in claim 1 wherein each of said first and second cushion pieces comprises a planar portion and an arcuate portion connected to said planar portion so that a hollow area is formed between said planar portion and said arcuate portion.

4. The seat cushion defined in claim 1 wherein said cushion portion of reduced thickness comprises a planar portion disposed between said first and second cushion pieces having a thickness less than that of said first and second cushion pieces.

5. The seat cushion defined in claim 1 further comprising fastening means for securing said cushion to the body of the user.

6. The seat cushion defined in claim 2 further comprising fastening means for securing said cushion to the body of the user.

7. The seat cushion defined in claim 6 wherein said fastening means comprises an elongated strap extending through said hollow area and around the body of the user.

8. A seat cushion comprising:

a planar piece of resilient material, a first arcuate piece of resilient material connected to and extending from said planar piece so that a hollow area is formed between said planar piece and said first arcuate piece, a second piece of resilient material connected to and extending from said planar piece so that a hollow area is formed between said planar piece and said second arcuate piece, said first and second arcuate pieces being spaced from each other so that a portion of said planar piece is disposed between said arcuate pieces to form a portion of reduced thickness between said first and second pieces.

9. The seat cushion defined in claim 8 further comprising fastening means for securing said cushion to the body of the user.

10. The seat cushion defined in claim 9 wherein said fastening means comprises an elongated strap extending through said hollow area and around the body of the user.

11. A seat cushion having a lateral dimension comprising:

a first elongated hollow tubular member of resilient material extending along substantially the entire width of the seat cushion, a second elongated hollow tubular member of resilient material connected to said first member at a point along the circumference of each member so that a portion of reduced cushion thickness is formed between said members with both said reduced thickness portion and said second hollow tubular member extending along substantially the entire width of the seat cushion.

* * * * *